US008087944B2

(12) United States Patent
Kumamoto et al.

(10) Patent No.: US 8,087,944 B2
(45) Date of Patent: Jan. 3, 2012

(54) CONNECTOR AND CONNECTOR COMBINATION FOR BALANCED TRANSMISSION

(75) Inventors: Tadashi Kumamoto, Tokyo (JP); Takeshi Okuyama, Tokyo (JP); Toru Yamakami, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/900,553

(22) Filed: Oct. 8, 2010

(65) Prior Publication Data

US 2011/0092084 A1 Apr. 21, 2011

(30) Foreign Application Priority Data

Oct. 15, 2009 (JP) ..... 2009-237856

(51) Int. Cl.
*H01R 13/648* (2006.01)

(52) U.S. Cl. ..... 439/108

(58) Field of Classification Search ..... 439/108, 439/101

See application file for complete search history.

(56) References Cited

U.S. PATENT DOCUMENTS 6,981,898 B2 1/2006 Akama et al.

FOREIGN PATENT DOCUMENTS

WO WO03-065512 8/2003

*Primary Examiner* — Phuong Dinh
(74) *Attorney, Agent, or Firm* — IPUSA, PLLC

(57) ABSTRACT

A connector includes a ground contact formed by a plate-shaped conductor member extending in a longitudinal direction of the connector, and a plurality of signal contact pairs arranged on both sides of the ground contact, with two signal contacts forming each signal contact pair arranged side by side along the longitudinal direction. The ground contact may include a plurality of first lead parts alternately extending towards mutually opposite sides of the plate-shaped conductor member.

20 Claims, 10 Drawing Sheets

CONNECTOR AND CONNECTOR COMBINATION FOR BALANCED TRANSMISSION

CROSS-REFERENCE TO RELATED APPLICATIONS

This application is based upon and claims the benefit of priority of the prior Japanese Patent Application No. 2009-237856, filed on Oct. 15, 2009, the entire contents of which are incorporated herein by reference.

BACKGROUND OF THE INVENTION

1. Field of the Invention

The present invention relates to connectors and connector combination which may be suited for balanced transmission.

2. Description of the Related Art

When transmitting data among computers, peripheral equipments, circuit boards, and the like, either the unbalanced transmission or the balanced transmission may be employed. The unbalanced transmission transmits the data by a signal voltage with respect to a ground potential. On the other hand, the balanced transmission transmits the data by differential signals using a potential difference between a signal pair. The balanced transmission is employed in various fields because the balanced transmission is less affected by noise compared to the unbalanced transmission.

A connector combination of a plug connector and a jack connector, may be used for the balanced transmission. A conventional plug connector may include a ground contact formed by a plate-shaped conductor, and a signal contact pair connecting to a signal line pair, which are alternately arranged in a longitudinal direction of the plug connector. On the other hand, a conventional jack connector may have a corresponding structure to receive the plug connector. But when the ground contacts and the signal contact pairs are alternately arranged, the number of parts forming the connector combination becomes relatively large. In addition, it may be difficult to reduce the pitch at which the ground contacts and the signal contact pairs are alternately arranged. In other words, it may be difficult to provide a large number of signal contact pairs without increasing the size of the plug connector along the longitudinal direction thereof.

In the general plug connector for the balanced transmission, the signal contacts forming the signal contact pair are arranged in a direction perpendicular to the longitudinal direction thereof. On the other hand, a plug connector (hereinafter referred to as the "proposed plug connector") in which the signal contacts forming the signal contact pair are arranged in the longitudinal direction thereof has been proposed in an International Patent Publication WO2003/065512A1, for example. According to this proposed plug connector, a plate-shaped first member having slits extends in the longitudinal direction thereof, and a plurality of second members are fitted into the slits to extend perpendicularly to the longitudinal direction. The first and second members form a ground contact. A plurality of signal contact pairs are arranged along the first member, so that mutually adjacent signal contact pairs are located side by side along the longitudinal direction and each signal contact pair is isolated by the second member. A lead part to connect the ground contact to a circuit board may extend from both ends of the second member.

However, in the general plug connector or the proposed plug connector for the balanced transmission, the ground contact is formed by a plurality of parts, and for this reason, it may be difficult to reduce the number of parts forming the plug connector. In addition, because each signal contact pair of the proposed plug connector is isolated by the second member of the ground contact, it may be difficult to reduce pitch at which the ground contact and the signal contact pairs are alternately arranged.

Furthermore, the proposed plug connector may not be able to cope with the recent demands to perform high-speed signal transmission. One of the functions of the ground contact is to shield each signal contact pair in order to reduce noise. However, if the electromagnetic coupling between the signal contact and the ground contact is relatively strong, a current flowing through the ground contact may resonate. Such a resonance may cause the noise to increase. Because the resonance occurs when a signal transmission frequency reaches a resonance frequency, the signal transmission may not be made at the resonant frequency or higher in the case of a connector in which the electromagnetic coupling is strong between the signal contact and the ground contact. The electromagnetic coupling becomes stronger as the signal and the ground contact become closer to each other in the connector.

SUMMARY OF THE INVENTION

Accordingly, it is a general object in one embodiment of the present invention to provide a novel and useful connector and connector combination, in which the problems described above may be suppressed.

Another and more specific object of in one embodiment of the present invention is to provide a connector and a connector combination, which may reduce the number of parts, reduce the pitch at which the contacts are arranged, and achieve a high-speed signal transmission.

According to one aspect of the present invention, there is provided a connector comprising a ground contact formed by a plate-shaped conductor member extending in a longitudinal direction of the connector; and a plurality of signal contact pairs arranged on both sides of the ground contact, with two signal contacts forming each signal contact pair arranged side by side along the longitudinal direction, wherein the ground contact includes a plurality of first lead parts alternately extending towards mutually opposite sides of the plate-shaped conductor member.

According to one aspect of the present invention, there is provided a connector combination comprising a first connector; and a second connector configured to make an electrical connection when connected to the first connector, the first connector comprising a first ground contact formed by a first plate-shaped conductor member extending in a longitudinal direction of the first connector; and a plurality of first signal contact pairs arranged on both sides of the first ground contact, with two signal contacts forming each first signal contact pair arranged side by side along the longitudinal direction, wherein the first ground contact includes a plurality of first lead parts alternately extending towards mutually opposite sides of the first plate-shaped conductor member.

Other objects and further features of the present invention will be apparent from the following detailed description when read in conjunction with the accompanying drawings.

DESCRIPTION OF THE PREFERRED EMBODIMENTS

In one embodiment of the present invention, connectors may be used to electrically connect circuit boards or modules. The circuit board or module may form an electronic device or equipment, such as computers and peripheral equipments.

Figure 1:
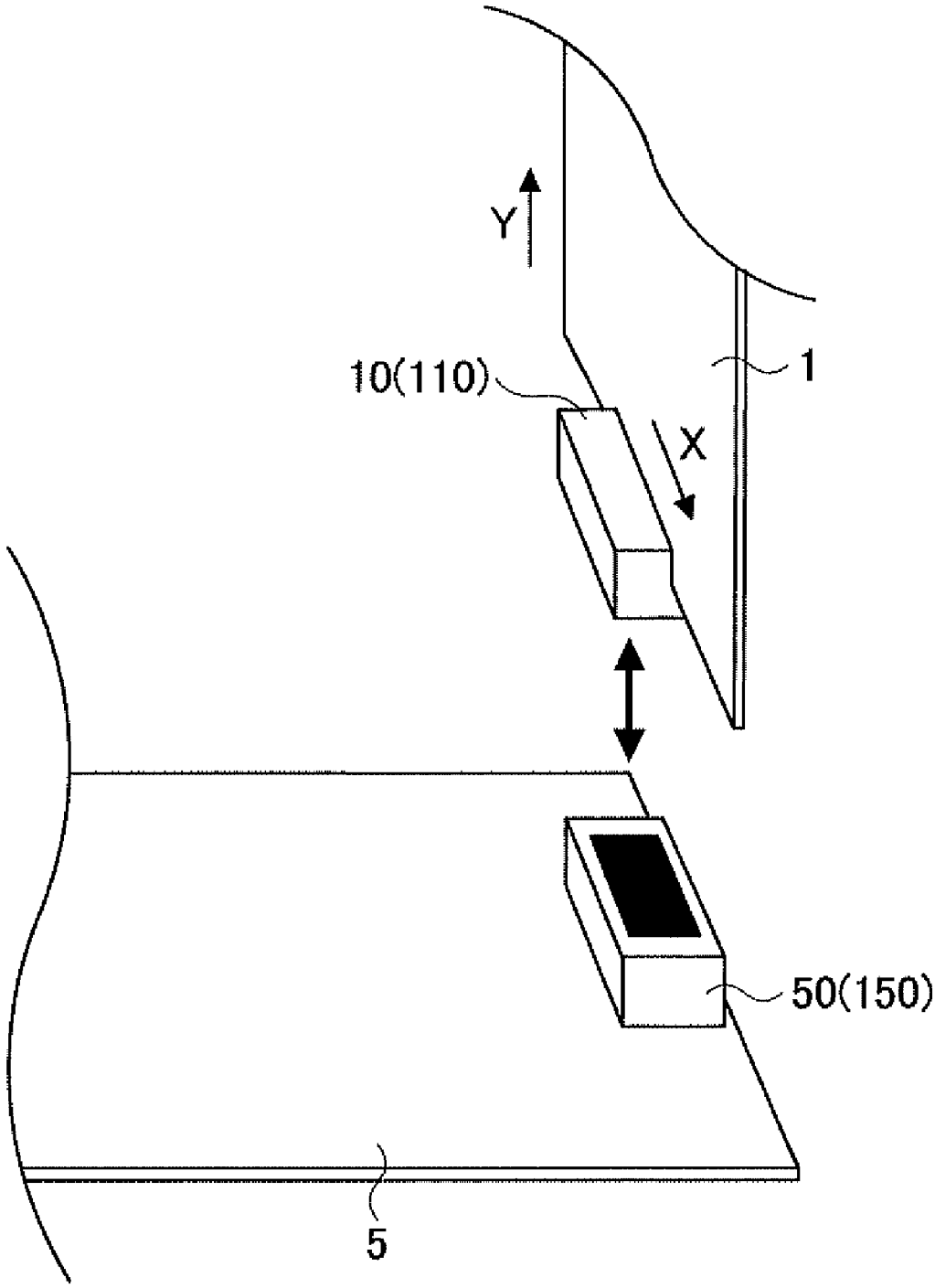
FIG. 1 is a perspective view for explaining an example of a connection of a plug connector and a jack connector.

FIG. 1 is a perspective view for explaining an example of a connection of a plug connector and a jack connector. In this example, a plug connector 10 is provided on a circuit board 1, and a jack connector 50 is provided on a circuit board 5. The illustration of contacts of the plug connector 10 and the jack connector 50 is omitted in FIG. 1.

The plug connector 10 and the jack connector 50 may be connected by relatively inserting one into the other in a direction Y illustrated in FIG. 1. The plug connector 10 and the jack connector 50 may be disconnected by relatively extracting one from the other in the direction Y. A longitudinal direction of the plug connector 10 and a longitudinal direction of the jack connector 50 are both in a direction X, which is perpendicular to the direction Y, in a state where the plug connector 10 and the jack connector 50 are connected. A balanced transmission may be performed between the circuit boards 1 and 5 via the plug connector 10 and the jack connector 50, by transmitting signals, power, and the like therebetween.

First Embodiment

A description will be given of the connector in a first embodiment of the present invention.

(Plug Connector)

Figure 2:
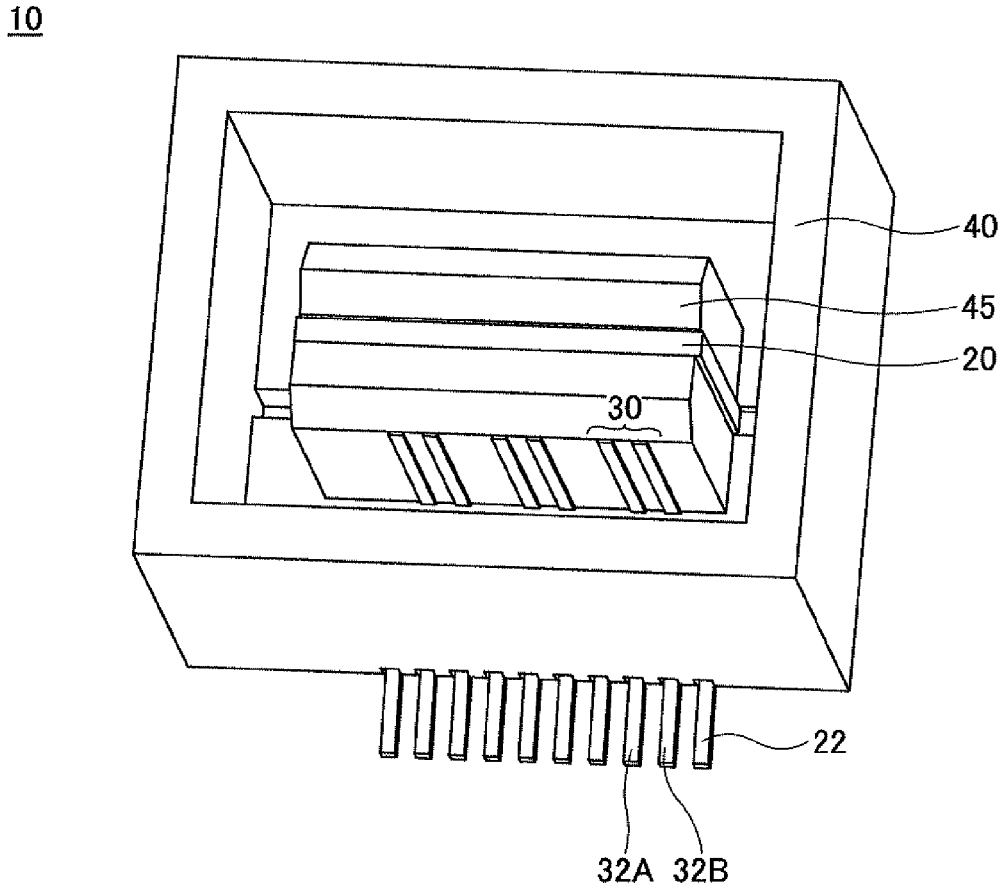
FIG. 2 is a perspective view illustrating an example of a plug connector in a first embodiment of the present invention.
Figure 3:
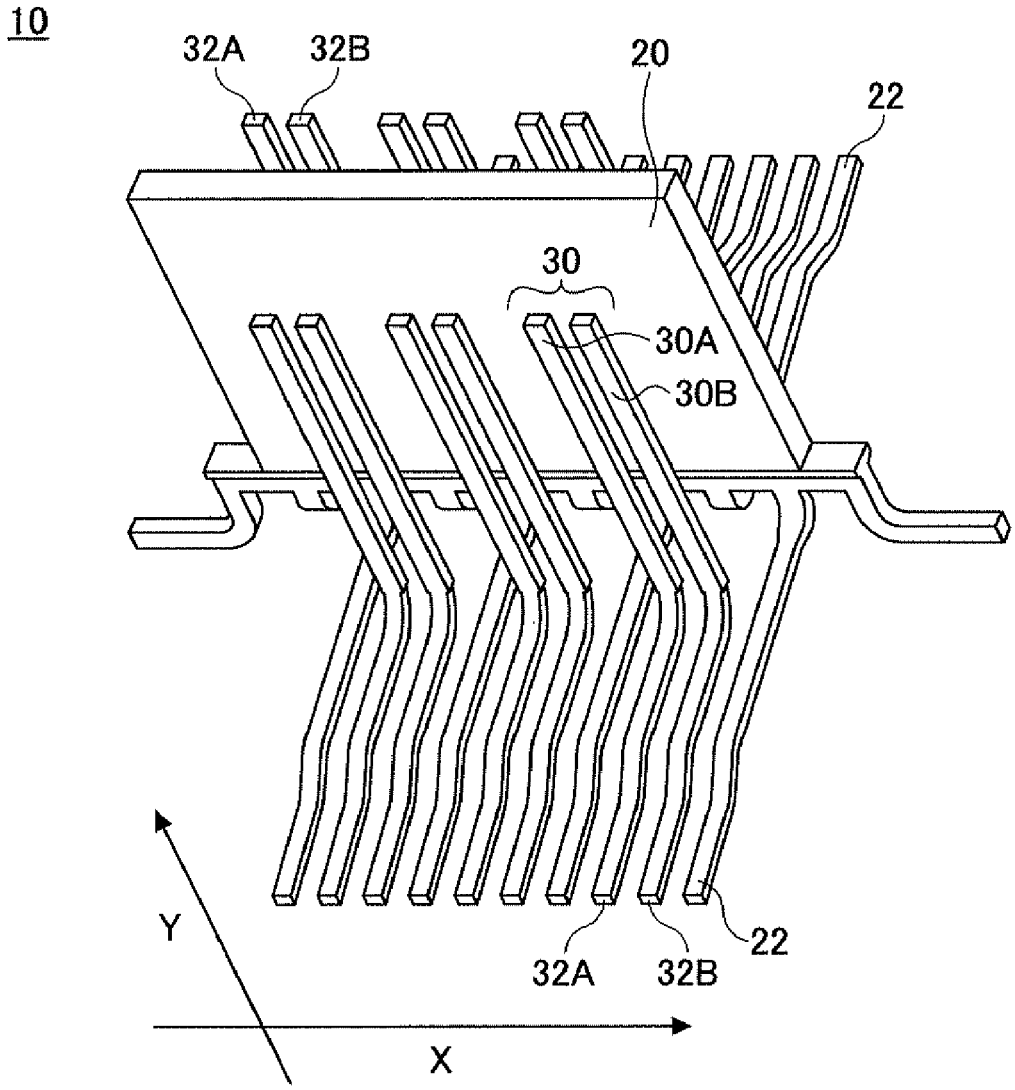
FIG. 3 is a perspective view illustrating conductor parts of the plug connector in the first embodiment.

FIG. 2 is a perspective view illustrating an example of the plug connector in the first embodiment of the present invention. FIG. 3 is a perspective view illustrating conductor parts of the plug connector in the first embodiment, by omitting illustration of insulator parts.

As illustrated in FIGS. 2 and 3, the plug connector 10 includes a (first) ground contact 20 and a plurality of (first) signal contact pairs 30. The ground contact 20 and the plurality of signal contact pairs 30 are formed by a conductor material which may be selected from metals including metals suited for the balanced transmission.

As illustrated in FIG. 3, the ground contact 20 may be formed by a plate-shaped member extending in the direction X, that is, in the longitudinal direction of the plug connector 10. A plurality of lead parts 22 alternately extend towards mutually opposite sides of the plate-shaped member forming the ground contact 20. The plurality of lead parts 22 are configured to electrically connect the ground contact 20 to the circuit board 1 illustrated in FIG. 1, for example.

For example, the ground contact 20, including the plurality of lead parts 22, may be formed from a single plate-shaped member, such as a single metal plate, by performing a process such as press molding and forming, and the process may include bending to form an approximate L-shape. By forming the ground contact 20, including the plurality of lead parts 22, from the plate-shaped member, it becomes possible to reduce the number of parts forming the plug connector 10 and to simplify the fabrication process of the plug connector 10.

The plurality of signal contact pairs 30 are disposed on both sides of the ground contact 20. Signal contacts 30A and 30B forming each signal contact pair 30 are arranged side by side to extend in the direction X. The signal contacts 30A and 30B forming the signal contact pair 30 may be configured to transmit a positive polarity signal and a negative polarity signal, respectively, that is, to transmit differential signals. Lead parts 32A and 32B extend towards a corresponding side of the ground contact 20 from the signal contacts 30A and 30B, respectively. The lead parts 32A and 32B are configured to electrically connect the signal contact pairs 30 to the circuit board 1 illustrated in FIG. 1, for example.

Figure 4:
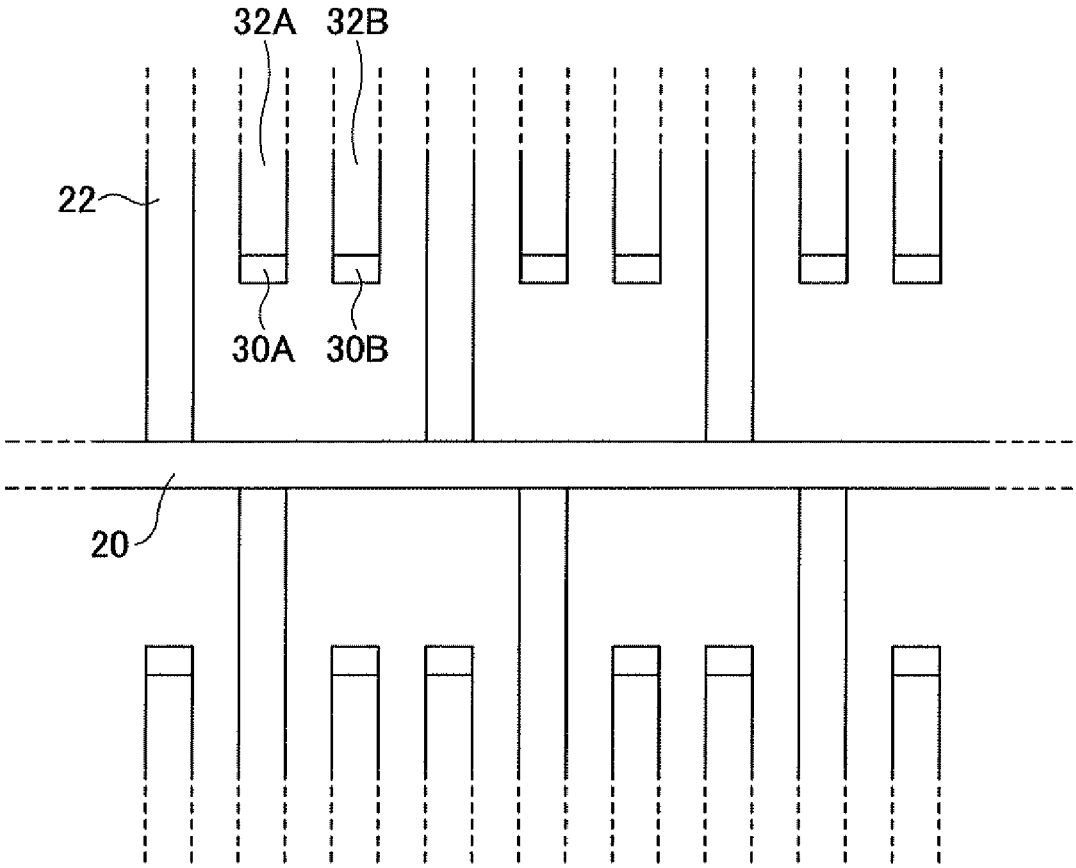
FIG. 4 is a diagram illustrating the conductor parts of the plug connector viewed from a direction Y in FIG. 3.

FIG. 4 is a diagram illustrating the conductor parts of the plug connector viewed from the direction Y in FIG. 3. The signal contact pairs 30 are arranged on both sides of the ground contact 20. In addition, the signal contact pairs 30 arranged in the direction X on one side of the ground contact 20 are offset along the direction X with respect to the signal contact pairs 30 arranged in the direction X on the other side of the ground contact 20, as illustrated in FIG. 4. On each side of the ground contact 20, the lead part 22 and the signal contact pair 30 are alternately arranged in the direction X. More particularly, the lead part 22, the signal contact 30A and the lead part 32A thereof belonging to one signal contact pair 30, and the signal contact 30B and the lead part 32B thereof belonging to this one signal contact pair 30 are arranged in this order in the direction X, and such an arrangement is repeated in the direction X on both sides of the ground contact 20. Hence, the lead part 22 and the signal contact pair 30 may be arranged at a relatively narrow pitch without increasing the size of the plug connector 10 along the longitudinal direction (X) thereof.

As illustrated in FIG. 2, the conductor parts of the plug connector 10 are held by a housing 40 and insulators 45, to thereby form the plug connector 10. The conductor parts of the plug connector 10 may include the ground contact 20 and the signal contact pairs 30. Each of the housing 40 and the insulators 45 may be made of an electrically insulating material such as synthetic resins. The synthetic resins may include thermoplastics, such as LOP (Liquid Crystal Polymer). Each of the housing 40 and the insulators 45 may be molded from the synthetic resin. Of course, the housing 40 and the insulators 45 may be integrally molded from the synthetic resin to form a single part or piece. The lead pars 32A and 32B extend outwards from the housing 40.

(Jack Connector)

Figure 5:
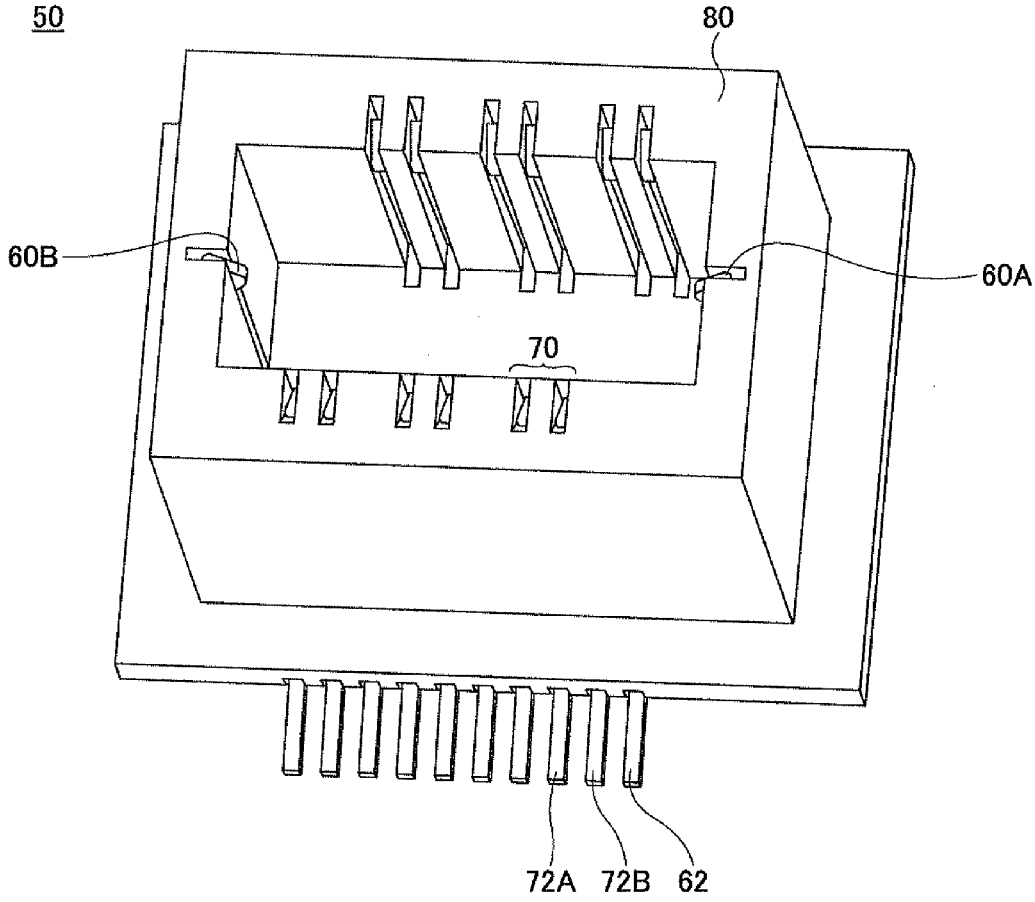
FIG. 5 is a perspective view illustrating an example of a jack connector in the first embodiment.
Figure 6:
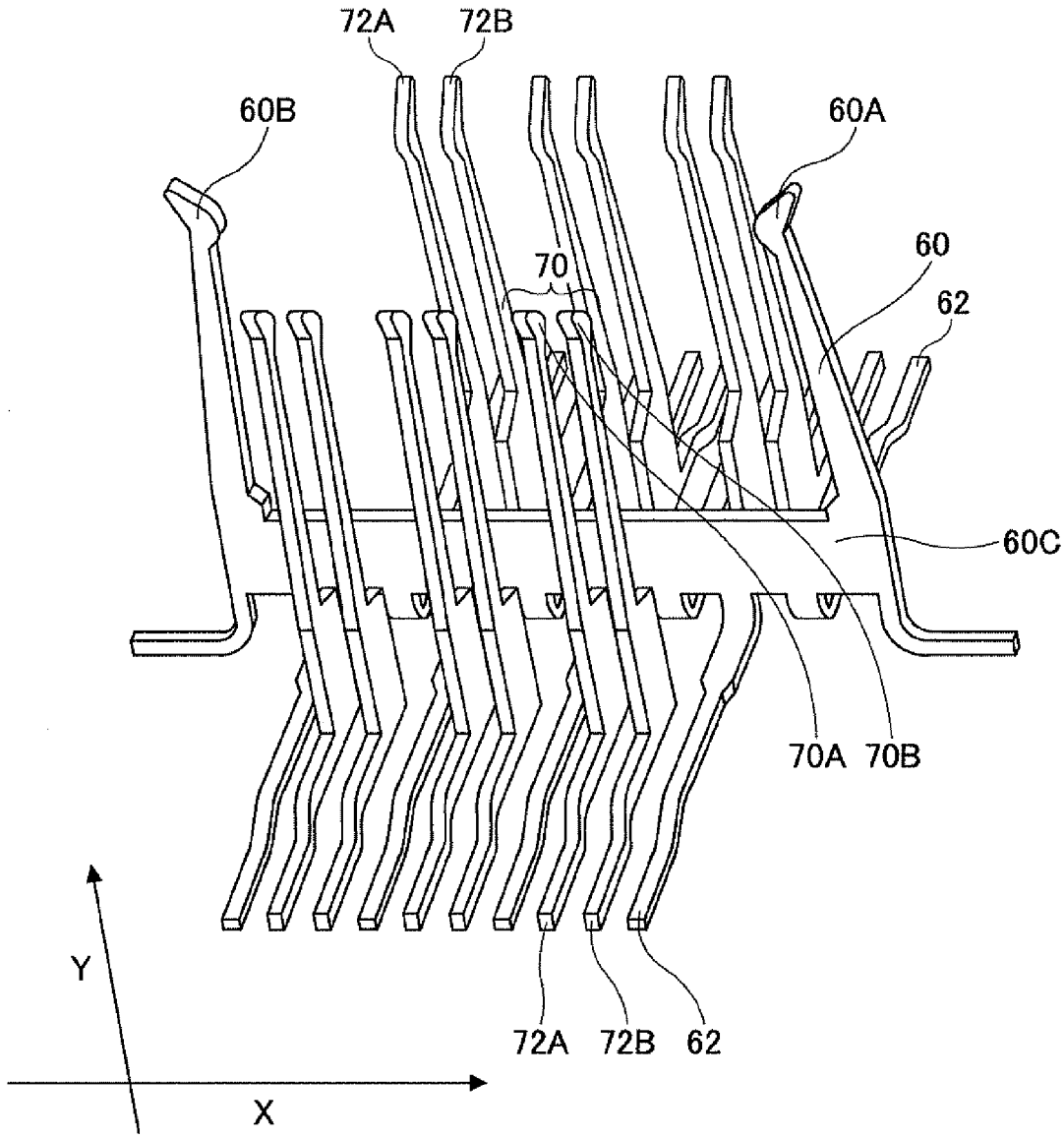
FIG. 6 is a perspective view illustrating conductor parts of the jack connector in the first embodiment.

FIG. 5 is a perspective view illustrating an example of the jack connector in the first embodiment. FIG. 6 is a perspective view illustrating conductor parts of the jack connector in the first embodiment, by omitting illustration of insulator parts.

As illustrated in FIGS. 5 and 6, the jack connector 50 includes a (second) ground contact 60 and a plurality of (second) signal contact pairs 70. The ground contact 60 and the plurality of signal contact pairs 70 are formed by a conductor material which may be selected from metals including metals suited for the balanced transmission.

As illustrated in FIG. 6, the ground contact 60 includes claws 60A and 60B that are integrally formed on a base part 60C that extends in the direction X and connects the claws 60A and 60B. A plurality of lead parts 62 alternately extend towards mutually opposite sides of the ground contact 60. The plurality of lead parts 62 are configured to electrically connect the ground contact 60 to the circuit board 5 illustrated in FIG. 1, for example.

When the plug connector 10 is inserted into the jack connector 50, the claws 60A and 60B press against the ground contact 20 of the plug connector 10 from the two ends. Hence, the ground contact 20 of the plug connector 10 and the ground contact 60 of the jack connector 50 are electrically connected when the plug connector 10 is inserted into the jack connector 50.

For example, the claws 60A and 60B, the base part 60C, and the lead parts 62 of the ground contact 60 may be formed from a single plate-shaped member, such as a single metal plate, by performing a process such as press molding and forming, and the process may include bending to form an approximate L-shape. By forming the ground contact 60 from the plate-shaped member, it becomes possible to reduce the number of parts forming the jack connector 50 and to simplify the fabrication process of the jack connector 50.

The plurality of signal contact pairs 70 are disposed on both sides of the ground contact 60. Signal contacts 70A and 70B forming each signal contact pair 70 are arranged side by side to extend in the direction X. The signal contacts 70A and 70B forming the signal contact pair 70 may be configured to transmit a positive polarity signal and a negative polarity signal, respectively, that is, to transmit differential signals. Lead parts 72A and 72B extend towards a corresponding side of the ground contact 60 from the signal contacts 70A and 70B, respectively. The lead parts 72A and 72B are configured to electrically connect the signal contact pairs 70 to the circuit board 5 illustrated in FIG. 1, for example.

Figure 7:
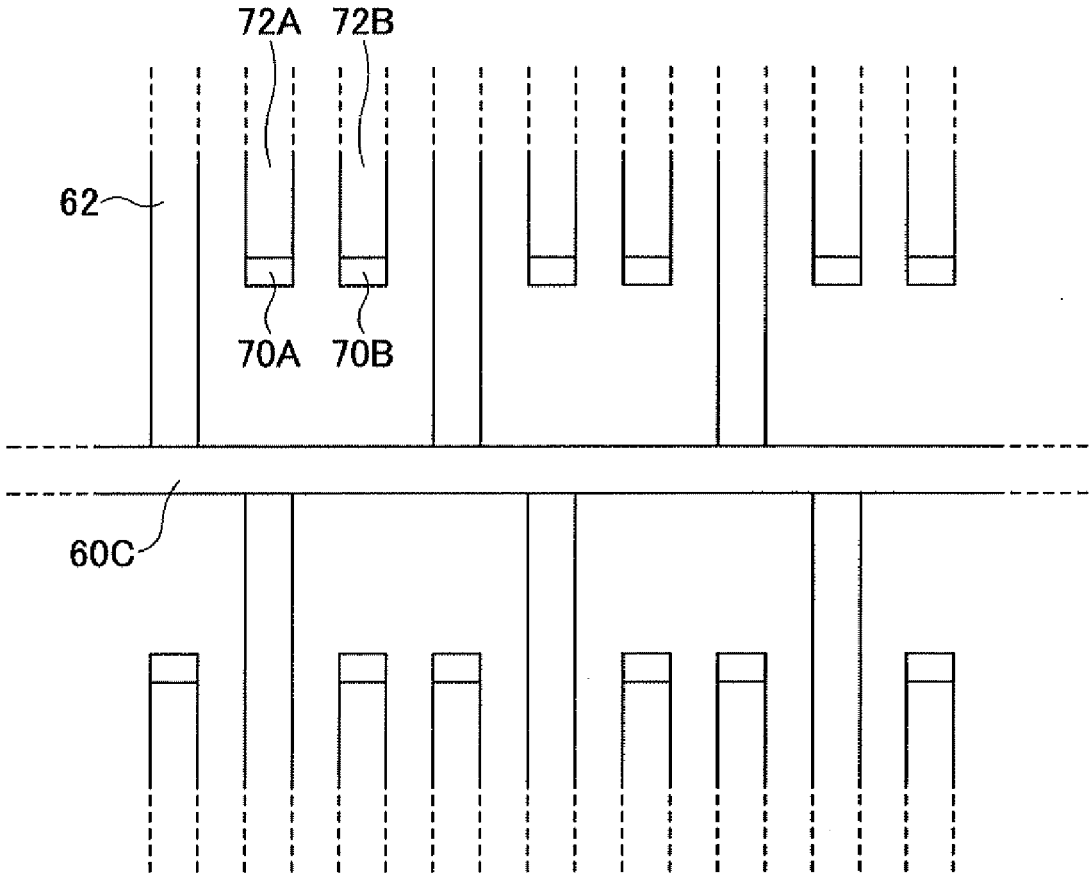
FIG. 7 is a diagram illustrating the conductor parts of the jack connector viewed from the direction Y in FIG. 6.

FIG. 7 is a diagram illustrating the conductor parts of the jack connector viewed from the direction Y in FIG. 6. The signal contact pairs 70 are arranged on both sides of the base part 60C of ground contact 60. In addition, the signal contact pairs 70 arranged in the direction X on one side the base part 60C are offset along the direction X with respect to the signal contact pairs 70 arranged in the direction X on the other side of the base part 60C, as illustrated in FIG. 7. On each side of the base part 60C, the lead part 62 and the signal contact pair 70 are alternately arranged in the direction X. More particularly, the lead part 72, the signal contact 70A and the lead part 72A thereof belonging to one signal contact pair 70, and the signal contact 70B and the lead part 72B thereof belonging to this one signal contact pair 70 are arranged in this order in the direction X, and such an arrangement is repeated in the direction X on both sides of the base part 60C. Hence, the lead part 62 and the signal contact pair 70 may be arranged at a relatively narrow pitch without increasing the size of the jack connector 50 along the longitudinal direction (X) thereof.

When the plug connector 10 is inserted into the jack connector 50, the signal contacts 70A and 70B of one signal contact pair 70 of the jack connector 50 press against the signal contacts 30A and 30B of the corresponding signal contact pair 30 of the plug connector 10 in a direction perpendicular to the XY-plane and towards the inner side of a housing 80 illustrated in FIG. 5. Hence, the signal contacts 70A and 70B of one signal contact pair 70 of the jack connector 50 make electrical contact with the signal contacts 30A and 30B of the corresponding signal contact pair 30 of the plug connector 10 when the plug connector 10 is inserted into the jack connector 50.

As illustrated in FIG. 5, the conductor parts of the jack connector 50 are held by the housing 80, to thereby form the jack connector 50. The conductor parts of the jack connector 50 may include the ground contact 60 and the signal contact pairs 70. The housing 80 may be made of an electrically insulating material such as synthetic resins. The synthetic resins may include thermoplastics, such as LOP. The housing 80 may be integrally molded from the synthetic resin. The lead pars 72A and 72B extend outwards from the housing 80.

When the plug connector 10 is inserted into and connected to the jack connector 50, ground terminals (not illustrated) of the circuit board 1 that are electrically connected to the lead parts 22 become electrically connected to ground terminals (not illustrated) of the circuit board 5 that are electrically connected to the lead parts 62, to thereby share a common ground potential. In addition, first signal terminals (not illustrated) of the circuit board 1 that are electrically connected to the lead parts 32A and first terminals (not illustrated) of the circuit board 5 that are electrically connected to the lead parts 72A become electrically connected. At the same time, second signal terminals (not illustrated) of the circuit board 1 that are electrically connected to the lead parts 32B and second terminals (not illustrated) of the circuit board 5 that are electrically connected to the lead parts 72B become electrically connected. Hence, at a receiving end, which may either be the circuit board 1 or the circuit board 5, each signal may be discriminated based on a potential difference between the corresponding first and second terminals in order to perform the balanced transmission.

(Resonance Suppression)

The connector combination for the balanced transmission in this embodiment is formed by the plug connector 10 and the jack connector 50. The ground contact 20 of the plug connector 10 is integrally formed by an electrically single part. In addition, the ground contact 60 of the jack connector 50 is integrally formed by an electrically single part. For this reason, compared to the conventional connector in which the signal contact pair is arranged along the direction perpendicular to the longitudinal direction of the connector and the ground contact and the signal contact pair are alternately provided along the longitudinal direction, the connector combination according to the first embodiment may suppress the generation of noise that may be caused by resonance of the current flowing through the ground contact 20 or the ground contact 60.

On the other hand, in order to arrange the signal contact pairs at a relatively narrow pitch in the proposed connector of the International Patent Publication WO2003/065512A1, for example, a distance separating the ground contact and the signal contact pair along a direction perpendicular to the longitudinal direction of the connector would have to be reduced. However, the reduced separation between the ground contact and the signal contact pair along the direction perpendicular to the longitudinal direction of the connector increases the strength of the electromagnetic coupling between the ground contact and the signal contact pair. Consequently, the resonance frequency of the current flowing through the ground contact of the proposed connector inevitably becomes lower than that of the connector according to the first embodiment.

Figure 8:
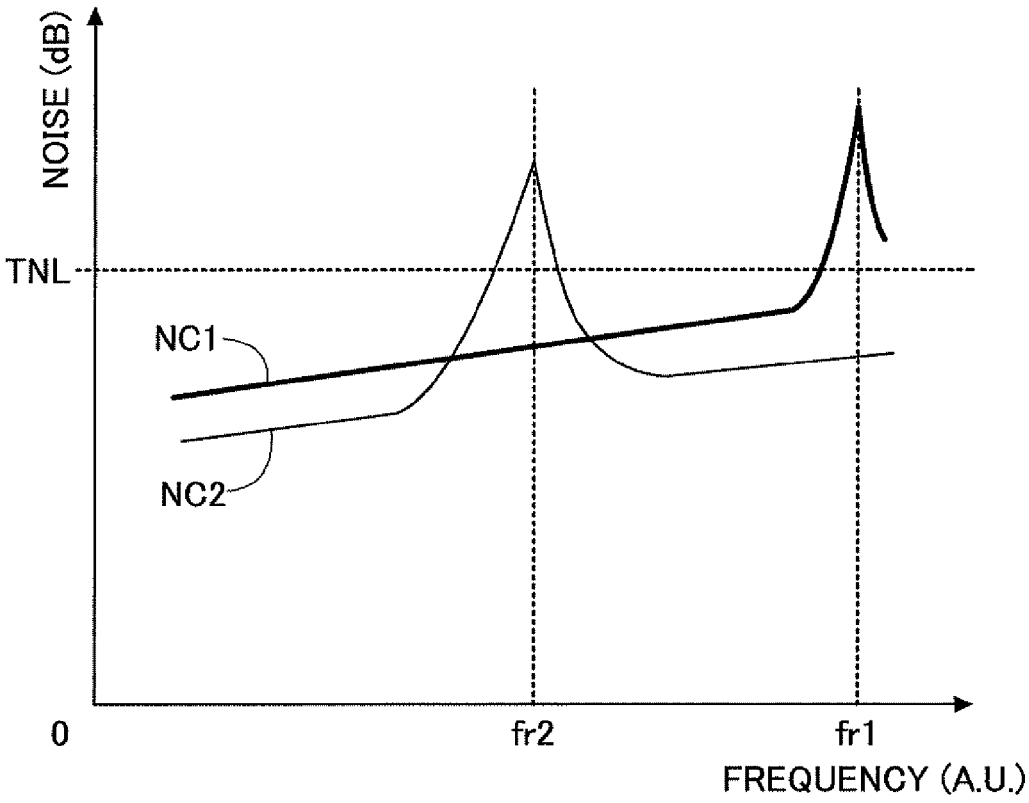
FIG. 8 is a diagram illustrating noise characteristics of the connector according to the first embodiment and the proposed connector.

FIG. 8 is a diagram illustrating noise characteristics of the connector according to the first embodiment and the proposed connector. In FIG. 8, the ordinate indicates the amount of noise (or noise level) in dB, and the abscissa indicates the frequency of the transmission signal in A.U. (Arbitrary Units). Further, in FIG. 8, NC1 denotes the noise characteristic of the connector 10 (or 50) according to the first embodiment, NC2 denotes the noise characteristic of the proposed connector, fr1 denotes a resonance frequency of the signal transmitted through the connector 10 (or 50) according to the first embodiment, fr2 (0<fr2<fr1) denotes a resonance frequency of the signal transmitted through the proposed connector, and TNL (TNL>0) denotes a tolerable noise level.

As illustrated in FIG. 8, the noise characteristic NC1 indicates a noise level slightly higher than that of the noise characteristic NC2 in a relatively low frequency range, because the signal contact pairs in the proposed connector are surrounded by a larger number of ground contacts compared to the connector according to the first embodiment. However, the resonance frequency fr1 of the current flowing through the ground contact 20 (or 60) in the connector 10 (or 50) according to the first embodiment is higher than the resonance frequency fr2 for the proposed connector. Hence, the connector 10 (or 50) according to the first embodiment is more suited for high-frequency signal transmission than the proposed connector.

Furthermore, the number of parts forming the connector 10 (or 50) according to the first embodiment is small compared to those of the conventional connector and the proposed connector, because ground contact of the connector 10 (or 50) may be formed from a single plate-shaped member, for example. Moreover, because the signal contacts 30A and 30B (or 70A and 70B) forming the signal contact pair 30 (or 70) are arranged in the longitudinal direction of the connector 10 (or 50) according to the first embodiment, the signal contact pairs 30 (or 70) on both sides of the ground contact 20 (or 60) are offset along the longitudinal direction, and unlike the conventional connector the ground contact and the signal contact pair are not provided alternately along the longitudinal direction of the connector 10 (or 50), the signal contact pair 30 (or 70) may be arranged at a relatively narrow pitch without increasing the size of the connector 10 (or 50) along the longitudinal direction.

Therefore, in the connector according to the first embodiment, it may be possible to reduce the number of parts, arrange the signal contact pairs at a relatively narrow pitch along the longitudinal direction of the connector, and cope with high-speed signal transmission.

Second Embodiment

A description will be given of the connector in a second embodiment of the present invention.

(Plug Connector)

Figure 9:
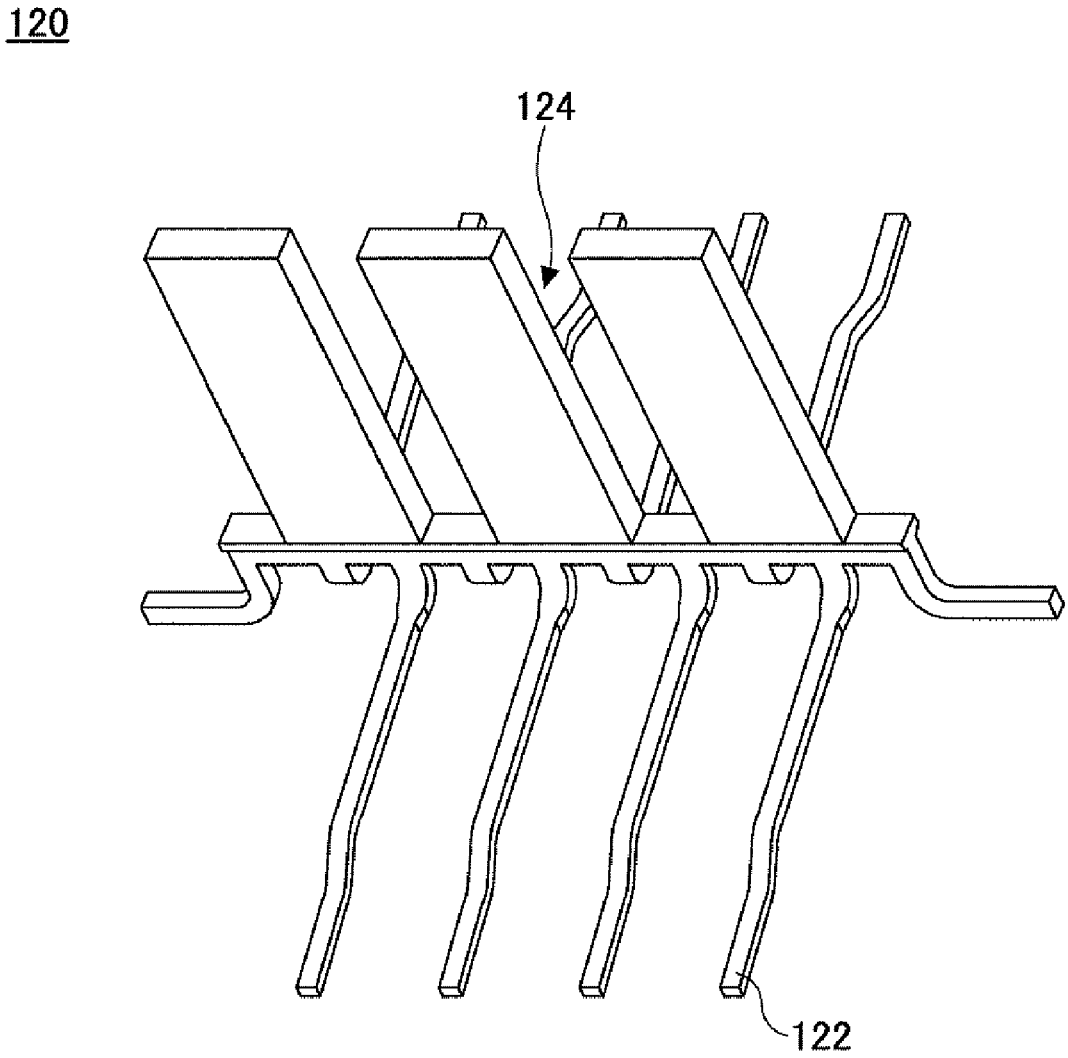
FIG. 9 is a perspective view illustrating conductor parts of the plug connector in a second embodiment of the present invention.

FIG. 9 is a perspective view illustrating conductor parts of the plug connector in a second embodiment of the present invention. Signal contacts of a plug connector 110 in this embodiment may be the same as that of the first embodiment described above, and thus, illustration and description thereof will be omitted. A (first) ground contact 120 illustrated in FIG. 9 may be formed by a conductor material which may be selected from metals including metals suited for the balanced transmission.

The ground contact 120 is formed by a plate-shaped member extending in the longitudinal direction (X) of the plug connector 110, and a plurality of slits 124 are formed in the plate-shaped member, as illustrated in FIG. 9. Of course, the plate-shaped member may only include a single slit 124. A plurality of lead parts 122 alternately extend towards mutually opposite sides of the plate-shaped member forming the ground contact 120. The plurality of lead parts 122 are configured to electrically connect the ground contact 120 to the circuit board 1 illustrated in FIG. 1, for example.

For example, the ground contact 120, including the plurality of lead parts 122, may be formed from a single plate-shaped member, such as a single metal plate, by performing a process such as press molding and forming, and the process may include bending to form an approximate L-shape. By forming the ground contact 120, including the plurality of lead parts 122, from the plate-shaped member, it becomes possible to reduce the number of parts forming the plug connector 110 and to simplify the fabrication process of the plug connector 110.

Signal contact pairs arranged in the direction X on one side of the ground contact 120 are offset along the direction X with respect to the signal contact pairs arranged in the direction X on the other side of the ground contact 120, in a manner similar to the structure illustrated in FIG. 4. Accordingly, illustration and description of the offset structure of the signal contact pairs will be omitted. The offset structure enables the signal contact pairs to be arranged at a relatively narrow pitch without increasing the size of the plug connector 110 along the longitudinal direction (X) thereof.

Insulator parts for holding the conductor parts of the plug connector 110 may be similar to those of the first embodiment, and illustration and description thereof will be omitted.

(Jack Connector)

Figure 10:
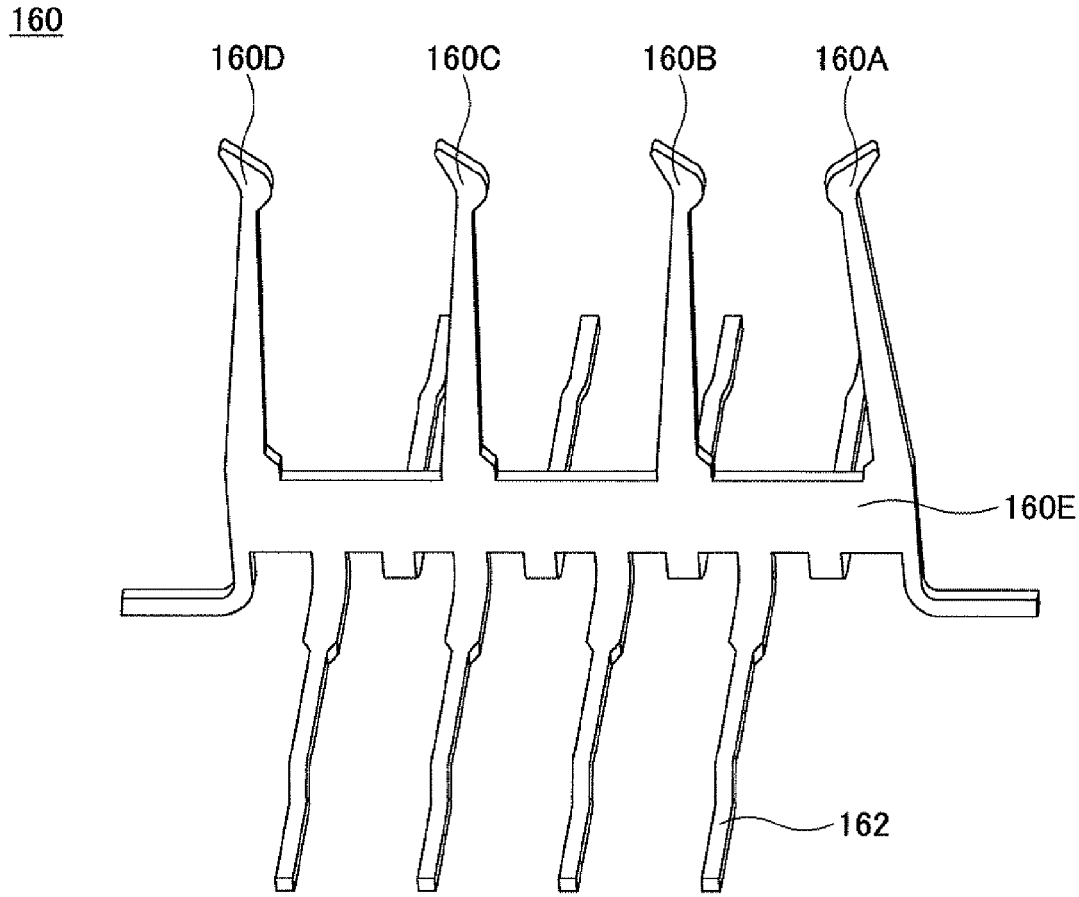
FIG. 10 is a perspective view illustrating conductor parts of the jack connector in the second embodiment.

FIG. 10 is a perspective view illustrating conductor parts of the jack connector in the second embodiment. Signal contacts of a jack connector 150 in this embodiment may be the same as that of the first embodiment described above, and thus, illustration and description thereof will be omitted. A (second) ground contact 160 illustrated in FIG. 10 may be formed by a conductor material which may be selected from metals including metals suited for the balanced transmission.

The ground contact 160 includes claws 160A, 160B, 160C, and 160D that intermittently but integrally formed on a base part 160E that extends in the longitudinal direction (X) of the jack connector 150, as illustrated in FIG. 10. The number of claws integrally formed on the base part 160E may vary depending on the number of slits 124 formed in the ground contact 120.

When the plug connector 110 is inserted into and connected to the jack connector 150, the claws 160B and 160C enter the corresponding slits 124 in the ground contact 120, and the claws 160A, 160B, 160C, and 160D press against the ground contact 120 in the direction X in order to electrically connect the ground contact 120 of the plug connector 110 and the ground contact 160 of the jack connector 150.

A plurality of lead parts 162 alternately extend towards mutually opposite sides of the base part 160E forming the ground contact 160. The plurality of lead parts 162 are configured to electrically connect the ground contact 160 to the circuit board 5 illustrated in FIG. 1, for example.

For example, the ground contact 160, including the claws 160A, 160B, 160C, and 1600, the base part 160E, and the plurality of lead parts 162, may be formed from a single plate-shaped member, such as a single metal plate, by performing a process such as press molding and forming, and the process may include bending to form an approximate L-shape. By forming the ground contact 160 from the plate-shaped member, it becomes possible to reduce the number of parts forming the jack connector 150 and to simplify the fabrication process of the plug connector 110.

Signal contact pairs arranged in the direction X on one side of the base part 160E are offset along the direction X with respect to the signal contact pairs arranged in the direction X on the other side of the base part 160E, in a manner similar to the structure illustrated in FIG. 7. Accordingly, illustration and description of the offset structure of the signal contact pairs will be omitted. This offset structure enables the signal contact pairs to be arranged at a relatively narrow pitch without increasing the size of the jack connector 150 along the longitudinal direction (X) thereof.

Insulator parts for holding the conductor parts of the jack connector 150 may be similar to those of the first embodiment, and illustration and description thereof will be omitted.

In this embodiment, the effects of suppressing the resonance of the current flowing through the ground contact 120 or the ground contact 160 may be the same as those of the first embodiment described in conjunction with FIG. 8. In addition, the second embodiment enables the average transmission channel length (or average transmission path length) of the ground contact 160 to be further reduced compared to the first embodiment. In the case of the first embodiment, the lead part 62 located at a central part of the ground contact 60 electrically connects to the ground contact 20 through a transmission channel length corresponding to approximately one-half the length of the base part 60C along the longitudinal direction (X). On the other hand, in the case of the second embodiment the lead part 162 located at a central part of the ground contact 160 may electrically connect to the ground contact 120 through a transmission channel length that is shorter than that of the first embodiment, because the electrical connection to the ground contact 120 may be made through the claws 160B and 160C located near the central part of the base part 160E.

Therefore, in the connector according to the second embodiment, it may be possible to reduce the number of parts, arrange the signal contact pairs at a relatively narrow pitch along the longitudinal direction of the connector, and cope with high-speed signal transmission.

Further, the present invention is not limited to these embodiments, but various variations and modifications may be made without departing from the scope of the present invention.

What is claimed is:

1. A connector comprising:

a ground contact formed by a plate-shaped conductor member extending in a longitudinal direction of the connector; and a plurality of signal contact pairs arranged on both sides of the ground contact, with two signal contacts forming each signal contact pair arranged side by side along the longitudinal direction, wherein the ground contact includes a plurality of first lead parts extending alternately towards mutually opposite sides of the plate-shaped conductor member along the longitudinal direction so that the first lead parts arranged in the longitudinal direction on one side of the plate-shaped conductor member are offset along the longitudinal direction with respect to the first lead parts arranged in the longitudinal direction on the opposite side of the plate-shaped conductor member.

2. The connector as claimed in claim 1, wherein the plurality of first lead parts extend alternately towards mutually opposite sides of the plate-shaped conductor member, along a direction perpendicular to the longitudinal direction.

3. The connector as claimed in claim 2, wherein the signal contact pairs arranged in the longitudinal direction on the one side of the plate-shaped conductor member are offset along the longitudinal direction with respect to the signal contact pairs arranged in the longitudinal direction on the other side of the plate-shaped conductor member.

4. The connector as claimed in claim 3, wherein each of the plurality of signal contact pairs includes two second lead parts extending in the direction perpendicular to the longitudinal direction and parallel to the first lead parts.

5. The connector as claimed in claim 4, wherein an arrangement in which one first lead part and the two second lead parts of one signal contact pair are alternately arranged in the longitudinal direction is repeated.

6. The connector as claimed in claim 1, wherein the plurality of first lead parts are formed from a single plate-shaped conductor member forming the ground contact, and each first lead part form an approximate L-shape with the ground contact when viewed in the longitudinal direction.

7. The connector as claimed in claim 1, wherein the plate-shaped conductor member includes a plurality of slits extending in a direction in which the connector is inserted with respect to another connector.

8. The connector as claimed in claim 1, wherein the ground contact includes a pair of claws arranged on opposite ends of the plate-shaped conductor member along the longitudinal direction.

9. The connector as claimed in claim 1, wherein the ground contact includes a plurality of claws arranged intermittently on the plate-shaped conductor member along the longitudinal direction.

10. A connector combination comprising:

a first connector; and a second connector configured to make an electrical connection when connected to the first connector, said first connector comprising:

a first ground contact formed by a first plate-shaped conductor member extending in a longitudinal direction of the first connector; and a plurality of first signal contact pairs arranged on both sides of the first ground contact, with two signal contacts forming each first signal contact pair arranged side by side along the longitudinal direction, wherein the first ground contact includes a plurality of first lead parts extending alternately towards mutually opposite sides of the first plate-shaped conductor member along the longitudinal direction so that the first lead parts arranged in the longitudinal direction on one side of the first plate-shaped conductor member are offset along the longitudinal direction with respect to the first lead parts arranged in the longitudinal direction on the opposite side of the first plate-shaped conductor member.

11. The connector combination as claimed in claim 10, wherein the plurality of first lead parts extend alternately towards mutually opposite sides of the first plate-shaped conductor member, along a direction perpendicular to the longitudinal direction.

12. The connector combination as claimed in claim 11, wherein the first signal contact pairs arranged in the longitudinal direction on the one side of the first plate-shaped conductor member are offset along the longitudinal direction with respect to the first signal contact pairs arranged in the longitudinal direction on the other side of the first plate-shaped conductor member.

13. The connector combination as claimed in claim 12, wherein each of the plurality of first signal contact pairs includes two second lead parts extending in the direction perpendicular to the longitudinal direction and parallel to the first lead parts.

14. The connector combination as claimed in claim 13, wherein an arrangement in which one first lead part and the two second lead parts of one first signal contact pair are alternately arranged in the longitudinal direction is repeated.

15. The connector combination as claimed in claim 10, wherein the plurality of first lead parts are formed from a single plate-shaped conductor member forming the first ground contact, and each first lead part form an approximate L-shape with the first ground contact when viewed in the longitudinal direction.

16. The connector combination as claimed in claim 10, wherein the second connector comprises:

a second ground contact formed by a second plate-shaped conductor member extending in a longitudinal direction of the second connector and including a pair of claws arranged on opposite ends along the longitudinal direction of the second connector, wherein the pair of claws press against ends of the first plate-shaped member forming the first ground contact of the first connector along the longitudinal direction of the first connector, to thereby electrically connect the first and second ground contacts hi a state where the first and second connectors are connected.

17. The connector combination as claimed in claim 10, wherein:

the first plate-shaped conductor member of the first connector includes a plurality of slits extending in a direction in which the first connector is inserted with respect to the second connector; and the second connector comprises:

a second ground contact formed by a second plate-shaped conductor member extending in a longitudinal direction of the second connector and including a plurality of claws arranged intermittently on the second plate-shaped conductor member along the longitudinal direction of the second connector;

wherein the plurality of claws press against ends of the first plate-shaped member forming the first ground contact of the first connector along the longitudinal direction of the first connector, via the slits, to thereby electrically connect the first and second ground contacts in a state where the first and second connectors are connected.

18. The connector combination as claimed in claim 10, wherein the first connector is provided on a first circuit board, and the second connector is provided on a second circuit board that is separate from the first circuit board.

19. The connector combination as claimed in claim 18, wherein the first and second circuit boards form mutually different electronic equipments.

20. The connector combination as claimed in claim 19, wherein the mutually different electronic equipments are configured to perform a balanced transmission via the connector combination.

* * * * *